US006182744B1

(12) United States Patent
Nakamura et al.

(10) Patent No.: US 6,182,744 B1
(45) Date of Patent: Feb. 6, 2001

(54) HEAT EXCHANGER APPARATUS INCLUDING AUXILIARY RADIATOR FOR COOLING EXOTHERMIC COMPONENT

(75) Inventors: Hiroki Nakamura, Chiryu; Toshihiko Muraki, Kariya; Hiroshi Nonoyama, Toyota; Takayoshi Matsuno, Okazaki; Shunkichi Suzaki, Toyota, all of (JP)

(73) Assignee: Denso Corporation, Kariya (JP)

( * ) Notice: Under 35 U.S.C. 154(b), the term of this patent shall be extended for 0 days.

(21) Appl. No.: 09/164,148

(22) Filed: Sep. 30, 1998

(30) Foreign Application Priority Data

Oct. 1, 1997 (JP) ..... 9-268913

(51) Int. Cl.[7] ..... F28D 7/10

(52) U.S. Cl. ..... 165/140; 165/148; 165/173; 62/509

(58) Field of Search ..... 165/140, 151, 165/153, 148, 132, 144; 62/507, 509

(56) References Cited

U.S. PATENT DOCUMENTS 4,063,431 * 12/1977 Dankowski ..... 62/239
5,176,200 * 1/1993 Shinmura ..... 165/144
5,476,138 * 12/1995 Iwasaki et al. ..... 165/41
5,546,761 * 8/1996 Matsuo et al. ..... 165/173
5,566,748 * 10/1996 Christensen ..... 165/67
5,582,027 * 12/1996 Baba et al. ..... 62/509
5,592,830 * 1/1997 Baba et al. ..... 62/509
5,628,206 * 5/1997 Baba ..... 165/176
5,713,217 * 2/1998 Baba ..... 62/509
5,813,249 * 9/1998 Matsuo et al. ..... 62/509
5,816,350 * 10/1998 Akira et al. ..... 180/68.4
5,875,650 * 3/1999 Nobuta et al. ..... 62/509
5,901,573 * 5/1999 Kobayashi ..... 165/132

* cited by examiner

*Primary Examiner*—Ira S. Lazarus
*Assistant Examiner*—Terrell McKinnon
(74) *Attorney, Agent, or Firm*—Harness, Dickey & Pierce, PLC

(57) ABSTRACT

A condenser has an outlet side region close to an outlet for discharging refrigerant from the condenser. The outlet side region does not face auxiliary radiator, which is disposed on a cooling air upstream side of the condenser. Accordingly, low temperature cooling air that does not pass through the auxiliary radiator can flow into the outlet side region of the condenser in which the refrigerant is lowered most. As a result, a difference in temperature between the refrigerant and the cooling air at the outlet side region becomes large. This prevents deterioration of cooling capacity of the condenser.

9 Claims, 5 Drawing Sheets

HEAT EXCHANGER APPARATUS INCLUDING AUXILIARY RADIATOR FOR COOLING EXOTHERMIC COMPONENT

CROSS REFERENCE TO RELATED APPLICATION

This application is based upon and claims the benefit of priority of the prior Japanese Patent Application No. 9-268913, filed on Oct. 1, 1997, the contents of which are incorporated herein by reference.

BACKGROUND OF THE INVENTION

1. Field of the Invention

This invention relates to a heat exchanger apparatus for a vehicle, including an auxiliary radiator which is disposed on a cooling air upstream side of a refrigerant condenser in a refrigerating cycle to cool an exothermic component such as an inverter for controlling rotation of a driving motor.

2. Description of the Related Art

In a conventional refrigerating cycle of an automotive air conditioning apparatus, a refrigerant condenser is disposed on a cooling air upstream side of a radiator for cooling an automotive engine, and it is not necessary for a heat exchanger to be disposed on a cooling air upstream side of the refrigerant condenser.

Recently, however, a hybrid powered automotive, which runs using an engine and a motor together, has been developed to ease air pollution by exhaust gas from automotive engines. The hybrid powered automotive has an inverter for controlling rotation of the motor. The inverter has electronic components such as a power transistor, a calorific value from which is relatively large. Therefore, it is necessary for the hybrid powered automotive to use an auxiliary radiator for cooling the inverter. When the auxiliary radiator is cooling air type, it is desirable for the auxiliary radiator to be disposed at a position where outer air (cooling air) easily flows in to enhance the cooling effect of the radiator. As a result, in some cases, there arises necessity to disposed the auxiliary radiator on the cooling air upstream side of the refrigerant condenser.

In such an arrangement, high temperature air, which has abrosbed heat in the auxiliary radiator, flows into the refrigerant condenser to decrease a difference in temperature between the cooling air and refrigerant in the refrigerant condenser. This significantly loweres condensation capacity of the refrigerant condenser. Especially, in a case that the refrigerant condenser has a supercooling part for supercooling the refrigerant, the supercooling part can not sufficinetly exhibit the supercooling performance due to the rise of the cooling air temperature.

SUMMARY OF THE INVENTION

The present invention has been made based on the above problem. An object of the present invention is to prevent deterioration of capacity of a refrigerant condenser in a heat exchanger apparatus including an auxiliary radiator which is disposed on a cooling air upstream side of the refrigerant condenser to cool an exothermic component. Another object of the present invention is to prevent cooling capacity of a supercooling part of a refrigerant condenser from deteriorating due to high temperature air, in a heat exchanger apparatus including an auxiliary radiator which is disposed on a cooling air upstream side of the refrigerant condenser to cool an exothermic component.

To achieve the objects described above, a condenser has a core portion for cooling refrigerant and the core portion has a first region and a second region closer to an outlet of the condenser than the first region. An auxiliary radiator, which is disposed on a cooling air upstream side of the condenser, is disposed only to face the first region of the core portion. Accordingly, the second region where a temperature of the refrigerant is lowered most can directly receive cooling air which does not pass through the auxiliary radiator, i.e., does not absorb heat in the auxiliary radiator and has low temperature. Therefore, even when outer air has high temperature, a difference in temperature between the refrigerant and the cooling air at the second region of the core portion closer to the outlet is sufficiently secured to prevent the deterioration of capacity of the condenser.

When the condenser has a condensation part for condensing the refrigerant, a receiver for removing liquid refrigerant from the refrigerant condensed by the condensation part, and a supercooling part for supercooling the liquid refrigerant from the receiver, the auxiliary radiator faces the condenser except at least part of the supercooling part. That is, the part of the supercooling part does not face the auxiliary radiator. Accordingly, low temperature cooling air directly flows into the part of the supercooling part without absorbing heat in the auxiliary radiator. As a result, the deterioration of cooling capacity of the supercooling part can be prevented.

BRIEF DESCRIPTION OF THE DRAWINGS

Other objects and features of the present invention will become more readily apparent from a better understanding of the preferred embodiments described below with reference to the following drawings.

DETAILED DESCRIPTION OF THE PREFERRED EMBODIMENTS (First Embodiment)

Figure 1:
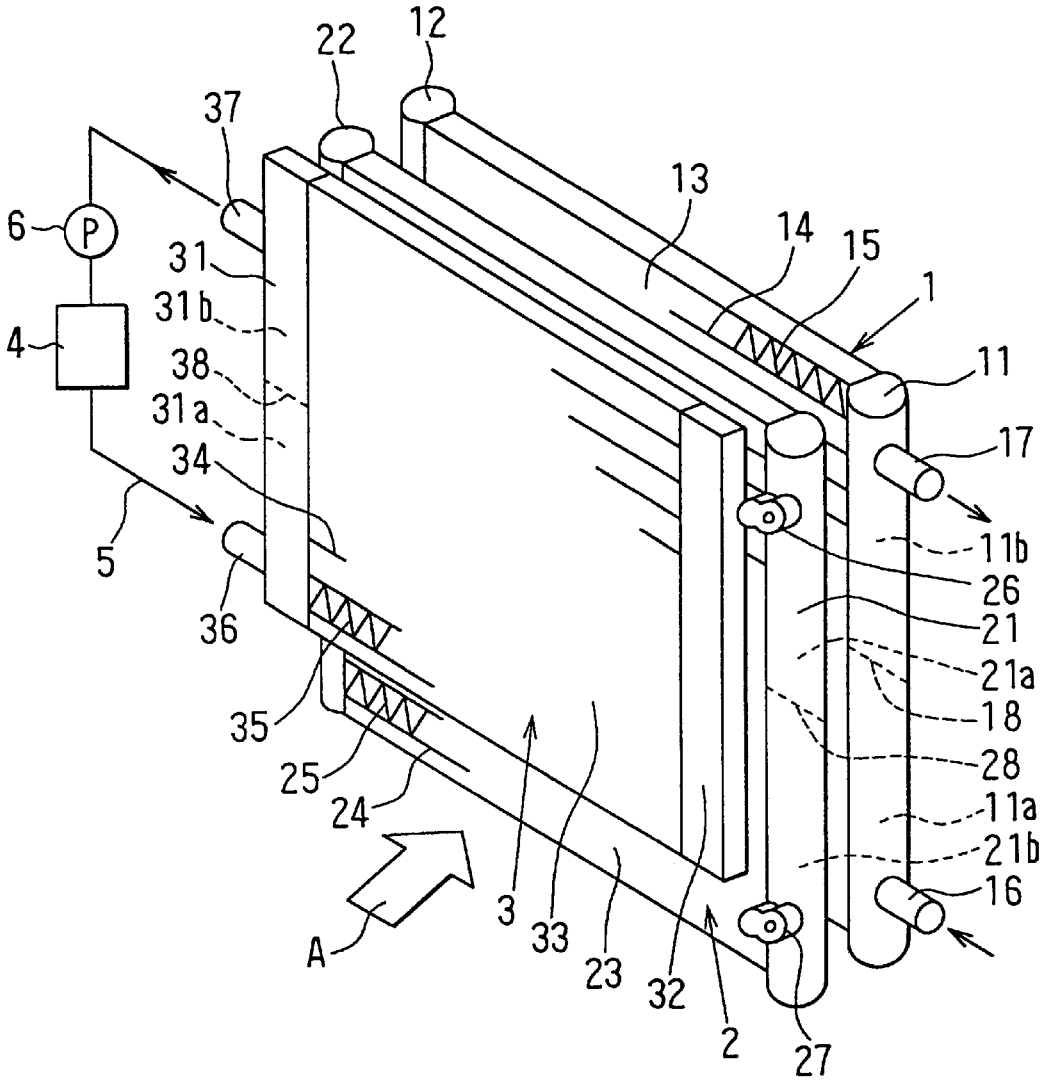
FIG. 1 is a perspective view showing a heat exchanger apparatus in a first preferred embodiment.

A radiator 1 shown in FIG. 1 is for cooling cooling water of an automotive engine (not shown). A cooling fan (not shown) is disposed on a downstream side of the radiator 1 to draw cooling air in flow direction A indicated with an arrow A. A refrigerant condenser (first heat exchanger) 2 of an automotive air conditioning apparatus is disposed on the cooling air (outer air) upstream side of the radiator 1 in the flow direction A. An auxiliary radiator (second heat exchanger) 3 is disposed on the cooling air upstream side of the refrigerant condenser 2. A cooling water circulating passage 5 is provided between the auxiliary radiator 3 and an exothermic component 4, and the cooling water circulates in the cooling water circulating passage 5 by an electric pump 6. The radiator 1, the refrigerant condenser 2, and the auxiliary radiator 3 are placed at the forefront part within an automotive engine room so that the cooling air drawn by the cooling fan flows in the flow direction A.

The radiator 1 has first and second header tanks 11, 12 which extend in a vertical direction with a specific interval therebetween, and a core portion 13 for heat exchange which is provided between the first and second header tanks 11, 12. The core portion 13 is composed of a plurality of flat tubes 14 which are arranged in parallel in the vertical direction to flow the cooling water therein in a horizontal direction between the first and second header tanks 11, 12, and a plurality of corrugated fins 15 respectively disposed between the adjacent two flat tubes 14. The flat tubes 14 and the corrugated fins 15 are joined to one another. An end portion of each of the flat tubes 14 communicates with the first header tank 11, while the other end portion of each of the flat tubes 14 communicates with the second header tank 12.

An inlet pipe 16 for conducting the cooling water from the engine is connected to the lower end portion of the first header tank 11, and an outlet pipe 17 for returning the cooling water to the engine side is joined to the upper end portion of the first header tank 11. In this embodiment, a separator 18 is disposed in the first header tank 11 to divide the inside of the first header tank 11 into a lower side chamber 11*a* on an inlet pipe side and an upper side chamber 11*b* on an outlet pipe side. Accordingly, the cooling air from the inlet pipe 16 passes through the lower side chamber 11*a*, the flat tubes 14 in the lower half of the core portion 13, the second header tank 12, the flat tubes 14 in the upper half of the core portion 13, and the upper side chamber 11*b* of the first header tank 11 in this order, and flows outside from the outlet pipe 17. In such a flow route, when the cooling water flows in the flat tubes 14 of the core portion 13, the cooling water gives heat to the cooling air through the corrugated fins 15 so that it is cooled.

The refrigerant condenser 2 has a constitution similar to that of the radiator 1. Specifically, the refrigerant condenser 2 has first and second header tanks 21, 22 which are disposed to define a specific interval therebetween, and a core portion 23 for heat exchange is disposed in the interval between the first and second header tanks 21, 22. The core portion 23 is composed of a plurality of flat tubes 24 and a plurality of corrugated fins 25 respectively disposed between the adjacent two flat tubes 24, which are joined to one another. An end portion of each of the flat tubes 24 communicates with the first header tank 21, while the other end portion of each of the flat tubes 24 communicates with the second header tank 22.

An inlet joint 26 is connected to the upper end portion of the first header tank 21 and an outlet joint 27 is connected to the lower end portion of the first header tank 21. Further, a separator 28 is disposed within the first header tank 21 to divide the inside of the first header tank 21 into an upper side chamber (inlet tank) 21*a* communicating with the inlet joint 26 and a lower side chamber (outlet tank) 21*b* communicating with the outlet joint 27. Accordingly, gaseous refrigerant enters the refrigerant condenser 2 from the inlet joint 26, passes through the upper side chamber 21*a*, the flat tubes 24 in the upper half of the core portion 23, the second header tank 22, the flat tubes 24 in the lower half of the core portion 23, and the lower side chamber 21*b* of the first header tank 21 in this order, and flows outside from the refrigerant condenser 2 through the outlet joint 27. The supperheated gaseous refrigerant having high temperature and high pressure, which is discharged from a compressor (not shown) in the refrigerating cycle of the automotive air conditioning apparatus, is cooled and is condensed by exchanging heat with the cooling air through the flat tubes 24 and the corrugated fins 25.

Likewise, the auxiliary radiator 3 has a constitution similar to those of the radiator 1 and the condenser 2. That is, the auxiliary radiator 3 has first and second header tanks 31, 32, which are disposed with a specific interval therebetween, and a core portion 33 composed of a plurality of flat tubes 34 and a plurality of corrugated fines 35 between the adjacent two flat tubes 34, which are joined to one another, is arranged in the interval between the first and second header tanks 31, 32. An end portion of each of the flat tubes 34 communicates with the first header tank 31, while the other end portion of each of the flat tubes 34 communicates with the second header tank 32.

An inlet pipe 36 of the cooling water is connected to the lower end portion of the first header tank 31, and an outlet pipe 37 of the cooling water is connected to the upper end portion of the first header tank 31. A separator 38 is disposed within the first header tank 31 to divide the inside of the first header tank 31 into a lower side chamber 31*a* communicating with the inlet pipe 36 and an upper side chamber 31*b* communicating with the outlet pipe 37. Accordingly, the cooling water enters the auxiliary radiator 3 from the inlet pipe 36, passes through the lower side chamber 31*a*, the flat tubes 34 in the lower half of the core portion 33, the second header tank 32, the flat tubes 34 in the upper half of the core portion 33, and the upper side chamber 31*b* of the first header tank 31 in that order, and flows outside from the auxiliary radiator 3 through the outlet pipe 37.

Figure 2:
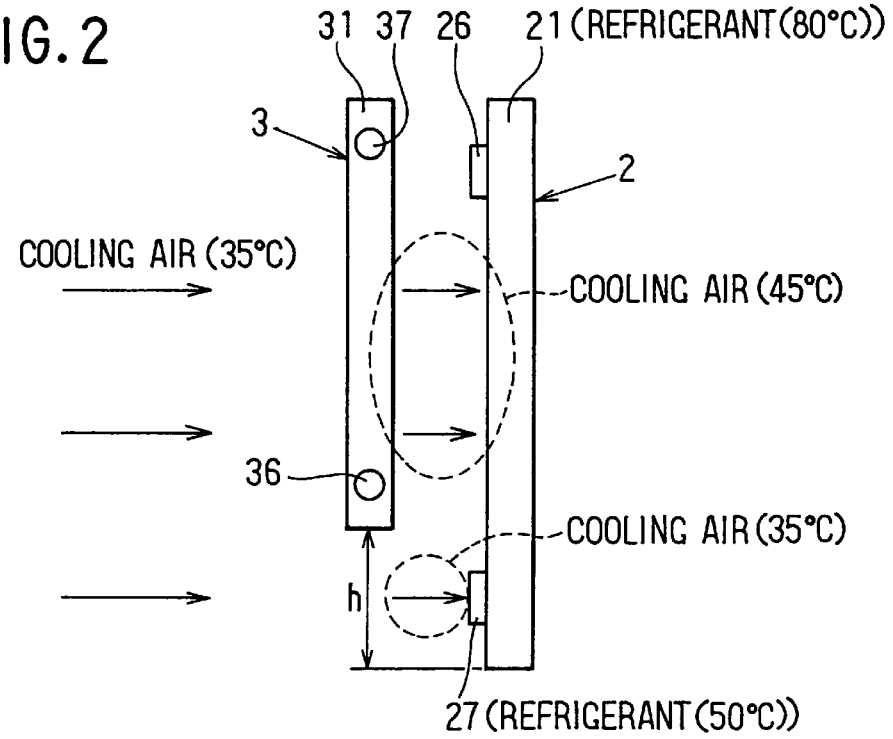
FIG. 2 is a side view showing an arrangement of a refrigerant condenser and an auxiliary radiator in the first embodiment.

In this embodiment, the heat exchanger apparatus composed of the radiator 1, the condenser 2, and the auxiliary radiator 3 described above is installed in the automotive engine room with an arrangement of the condenser 2 and the auxiliary radiator 3 shown in FIG. 2. That is, the auxiliary radiator 3, which is positioned on the upstream side of the condenser 2, is arranged with a lowermost end portion, a position of which is higher than that of the lowermost end portion of the condenser 2 by a specific height h in the vertical direction, i.e., in a direction perpendicular to the flat tubes 34. The auxiliary radiator 3 does not face the refrigerant outlet region of the core portion 23 of the condenser 2 on the outlet joint side. Accordingly, the cooling air directly flows into the refrigerant outlet region of the core portion 23 of the condenser 2 without being heated by the auxiliary radiator 3.

Figure 3:
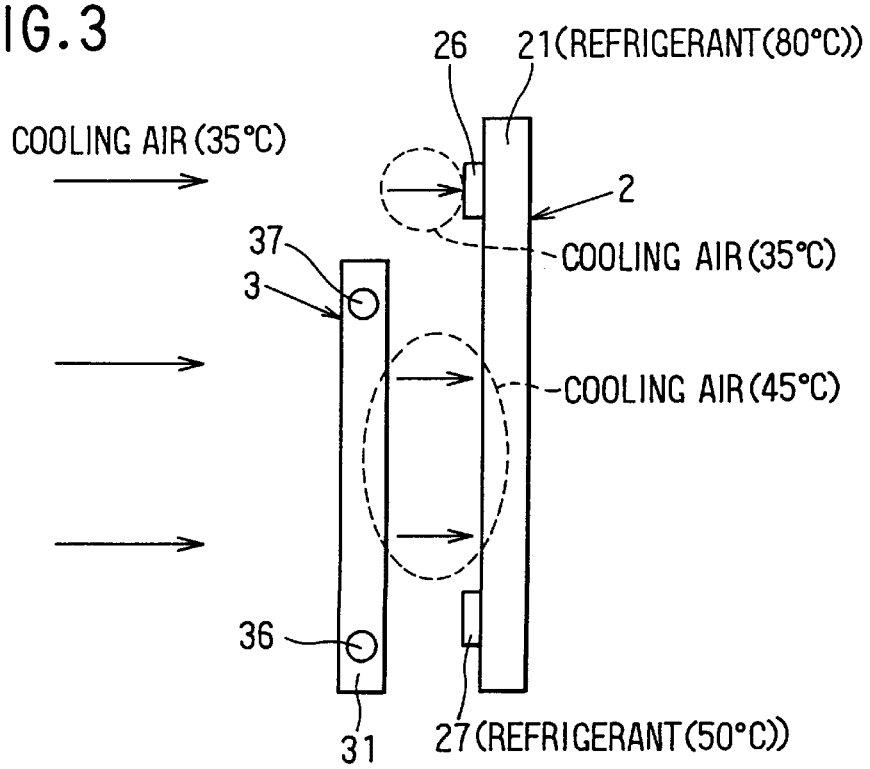
FIG. 3 is a side view showing an arrangement of the refrigerant condenser and the auxiliary radiator in a comparative example.

As opposed to this, according to a comparative example shown in FIG. 3, the auxiliary radiator 3 is disposed to face the refrigerant outlet region of the core portion 23 of the radiator 2. In this case, the cooling air flows into the refrigerant outlet region of the core portion 23 of the condenser 2 after absorbing heat in the auxiliary radiator 3 to have a high temperature. As a result, the following deficiencies occur. Specifically, an example in a summer season when a temperature of the outer air is high will be explained. When the temperature of the outer air is approximately 35° C., the cooling air is heated up to approximately 45° C. by absorbing heat in the auxiliary radiator 3. On the other hand, the gaseous refrigerant discharged from the compressor of the refrigerating cycle has a temperature of for example approximately 80° C. and releases heat while flowing in the flat tubes 24 of the condenser 2 such that the temperature thereof gradually decreases.

Under normal operating conditions of the refrigerating cycle in the summer season, the temperature of the refrigerant decreases to approximately 50° C. around the outlet joint 27 of the condenser 2. However, when the auxiliary radiator 3 and the condenser 2 are arranged as shown in FIG. 3, the cooling air having high temperature of for example approximately 45° C., which has absorbed heat in the auxiliary radiator 3, flows into the refrigerant outlet region of the condenser 2. In this case, the difference in temperature between the refrigerant and the cooling air is small, and therefore the heat exchanging property is also small.

As opposed to this, according to this embodiment, because the auxiliary radiator 3 is arranged not to face the refrigerant outlet region of the core portin 23 of the condenser 2 as shown in FIG. 2, the cooling air directly flows into the refrigerant outlet region of the core portion 23 of the condenser 2. Accordingly, the difference in temperature between the refrigerant and the cooling air becomes sufficiently large. For example, in the summer season, the refrigerant of approximately 50° C. in temperature and the cooling air of approximately 35° C. in temperature can exchange heat with one another in the refrigerant outlet region of the condenser 2. As a result, the heat exchanging property in the refrigerant outlet region can be prevented from deteriorating. Incidentally, because the temperature of the refrigerant flowing in the refrigernat inlet region and refrigerant intermediate region of the condenser 2 is high, even if the high temperature cooling air flows toward the inlet region and the intermediate region, the deterioration of the heat exchanging property is insignificant.

(Second Embodiment)

Figure 4:
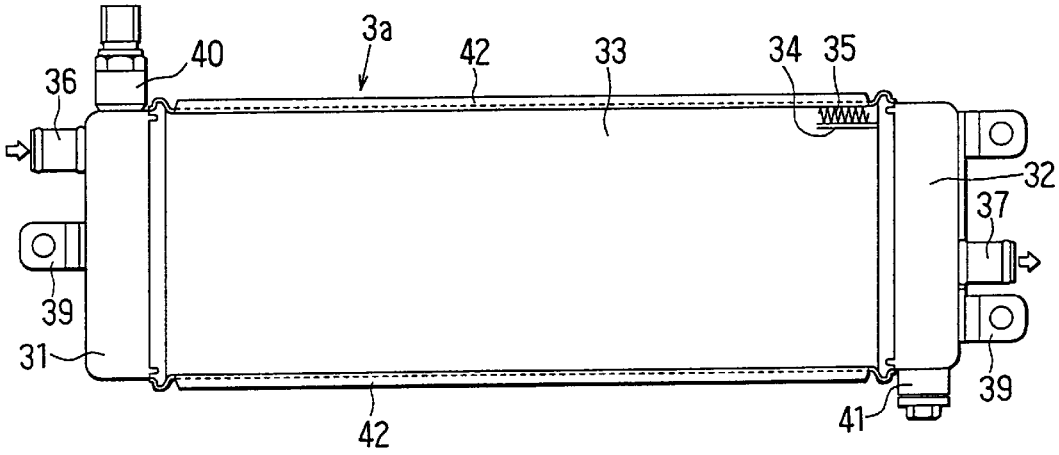
FIG. 4 is a front view showing an auxiliary radiator in a second preferred embodiment.
Figure 5:
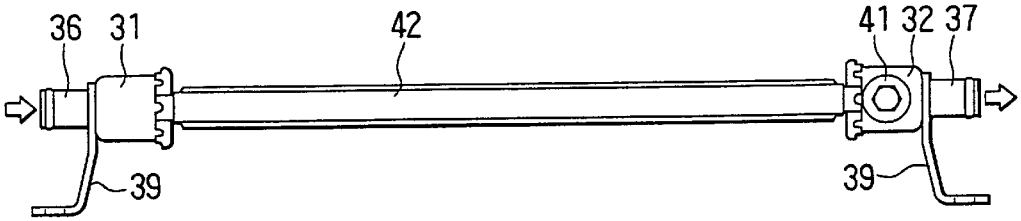
FIG. 5 is a bottom view showing the auxiliary radiator of FIG. 4.

A second preferred embodiment will be described referring to FIGS. 4, 5. The same parts and components as those in the first embodiment are indicated with the same reference numerals. In the first embodiment, the auxiliary radiator 3 has the inlet and outlet pipes 36, 37, both of which are joined to the first header tank 31, and the inside of the first header tank 31 is partitioned by the separator 38 into the lower side chamber 31*a* and the upper side chamber 31*b*. In the second embodiment, only the inlet pipe 36 is joined to the first header tank 31, and the outlet pipe 37 is joined to the second header tank 32. An auxiliary radiator 3a in the second embodiment does not have the separator 38 in the first header tank 31.

Therefore, in the second embodiment, the cooling water enters the first header tank 31 from the inlet pipe 36, is distributed to all of the flat tubes 34, flows in the flat tubes 34 toward the second header tank 32, meets again in the second header tank 32, and flows outside from the outlet pipe 37. As shown in FIGS. 4, 5, in the auxiliary radiator 3*a*, attachment brackets 39 are further joined to the first and second header tanks 31, 32, respectively, for fixing the auxiliary radiator 3 to the vehicle. A water temperature sensor 31 is disposed on the upper portion of the first header tank 31, a drain cock 41 is disposed on the bottom portion of the second header tank 32, and side plates 42 are disposed on the upper and lower ends of the core portion 33. The other features and effects in the second embodiment are the same as those in the first embodiment described above.

(Third Embodiment)

Figure 6:
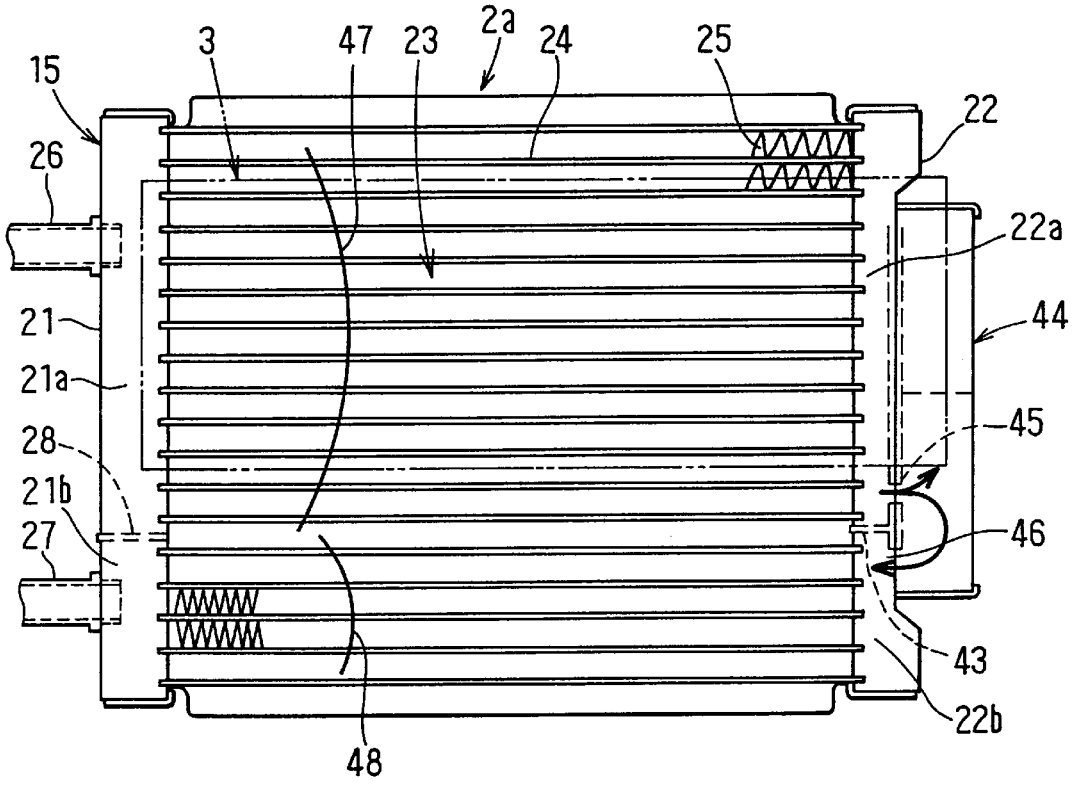
FIG. 6 is a front view showing a refrigerant condenser in a third preferred embodiment.

Referring to FIG. 6, a condenser 2*a* in a third preferred embodiment integrally has a receiver for separating liquid refrigerant and gaseous refrigerant from one another and a supercooling apparatus for supercooling the liquid refrigerant. Herebelow, the differential points between the condenser 2 in the first embodiment and the supercooling apparatus integral refrigerant condenser 2*a* in the third embodiment will be described.

In the condenser 2*a*, not only the first header tank 21 but also the second header tank 22 is partitioned by a separator 43 at the same height as that of the separator 28 of the first header tank 21 into an upper side chamber 22*a* and a lower side chamber 22*b*. A receiver 44 is integrally brazed to the outer side face of the second header tank 22. The receiver 44 has a generally cylindrical shape. Each part of the refrigerant condenser 2*a* is made of aluminum material, and integrally assembled by brazing. The inside space of the receiver 44 communicates with the upper side chamber 22*a* of the second header tank 22 through a first communication hole 45 which is provided on a slightly upper side of the separator 43, and communicates with the lower side chamber 22*b* through a second communication hole 46 which is provided on a slightly lower side of the separator 43.

In the refrigerant condenser 2*a*, the gaseous refrigerant enters from the inlet joint 26, flows in the upper side chamber 21*a* of the first header tank 21 and in the flat tubes 24 in the upper half of the core portion 23 toward the second header tank 22 while being cooled and being condensed.

Then, the refrigerant flows into the upper side chamber 22*a* of the second header tank 22, and further flows into the receiver 44 through the first communication hole 45.

In the receiver 44, the refrigerant is separated into the gaseous refrigerant and the liquid refrigerant. Accordingly, the liquid refrigerant pools at the lower portion in the receiver 44. The liquid refrigerant flows into the lower side chamber 22*b* of the second header tank 22 through the second communication hole 46, and flows in the flat tubes 24 toward the first header tank 21 while being supercooled. The supercooled liquid refrigerant flows outside from the outlet joint 27 after passing through the lower side chamber 21*a* of the first header tank 21. Thus, the upper side part of the core portion 23 with respect to the separators 28, 43 serves as a condensation part 47 in which the gaseous refrigerant discharged from the compressor exchanges heat with the cooling air to be cooled and be condensed. The lower side part of the core portion 23 with respect to the separator 28, 43 serves as a supercooling part 48 in which the gaseous refrigerant separated from the liquid refrigerant in the receiver 44 exchanges heat with the cooling air to be supercooled. That is, the refrigerant condenser 2*a* in this embodiment is integrally composed of, from the upstream side in sequence, the condensation part 47, the receiver 44, and the supercooling part 48.

The position where the auxiliary radiator 3 is arranged is indicated with a two-dot chain line in FIG. 6. In this embodiment, the auxiliary radiator 3 is disposed on the cooling air upstream side of the refrigerant condenser 2*a* and on the upper portion of the supercooling part 48. The low temperature cooling air having approximately the same temperature as that of the outer air directly flows into the supercooling part 48 without passing through the auxiliary radiator 3. As a result, the difference in temperature between the liquid refrigerant flowing in the flat tubes 24 of the supercooling part 48 and the cooling air becomes large, and therefore the supercooling part 48 can securely exhibit the supercooling effect even when the temperature of the outer air is relatively high. The other features and effects in the third embodiment are the same as those in the fourth embodiment.

(Fourth Embodiment)

Figure 7:
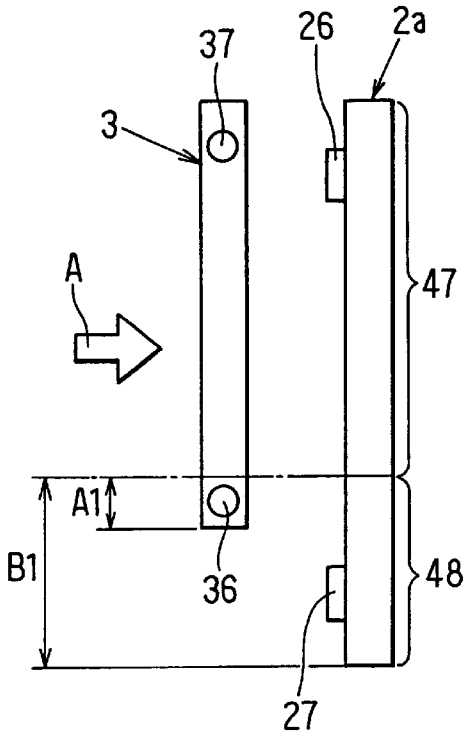
FIG. 7 is a side view showing an arrangement of the refrigerant condenser and the auxiliary radiator in a fourth preferred embodiment.

FIG. 7 shows a case that the auxiliary radiator 3 needs to be arranged to face a part of the supercooling part 48 of the supercooling apparatus integral refrigerant condenser 2*a* in the third embodiment due to a dimensional relationship between the auxiliary radiator 3 and the refrigerant condenser 2*a*.

Figure 8:
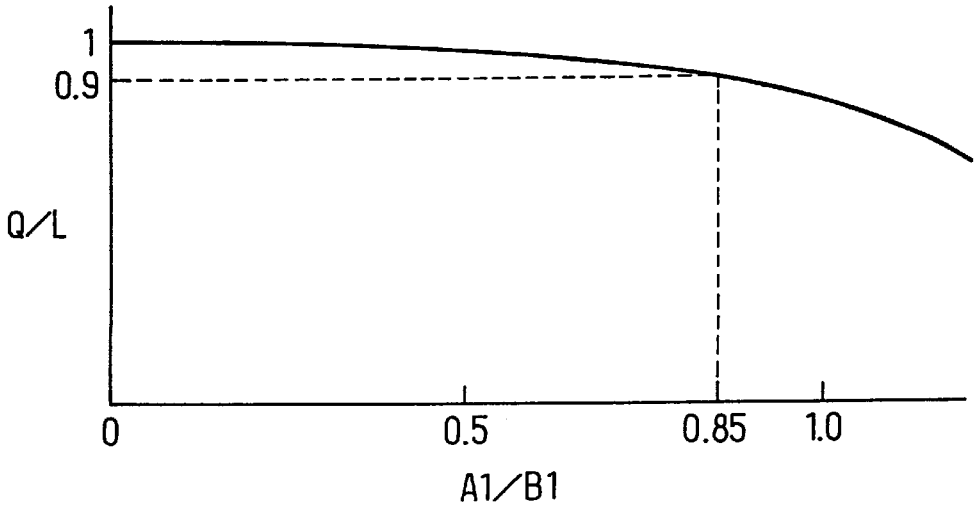
FIG. 8 is a graph showing a relationship between a cooling capacity and a dimensional ratio of a facing portion of the auxiliary radiator relative to a supercooling part of the refrigerant condenser.

In such a case, the inventors of the present invention examined and studied a relationship between a cooling capacity and a ratio of a height A1 of the facing portion of the auxiliary radiator 3 facing the supercooling part 48 with respect to a height B1 of the supercooling part 48. The result is shown in FIG. 8. That is, in FIG. 8, an axis of abscissas indicates the ratios A1/B1 described above, and an axis of ordinates indicates ratios of the cooling capacity Q relative to an air conditioning apparatus consumptive power (consumptive electric power) L. From the result shown in FIG. 8, it is known that when the ratio A1/B1 is equal to or smaller than 0.85, the ratio Q/L becomes equal to or larger than 0.9. Accordingly, in the supercooling apparatus integral refrigerant condenser 2*a*, when the ratio A1/B1, which represents the dimensional ratio of the facing portion of the auxiliary radiator 3 facing the supercooling part 48 relative to the supercooling part 48, is set within a specific range, the supercooling performance can be sufficiently provided and at the same time the space where the auxiliary radiator 3 is disposed can be secured.

(The other Embodiments)

In the supercooling apparatus integral refrigerant condenser 2*a* in the third and fourth embodiments, it is not always necessary that the receiver 44 is integrally joined to the header tank 21 or 22. The receiver 44 may be disposed apart from the header tanks 21, 22, and be connected to one of the header tanks 21, 22 through a refrigerant pipe. In this case, only the condensation part 47 and the supercooling part 48 in the refrigerant condenser 2*a* are integrally assembled. The exothermic component 4 as an object which is to be cooled by the auxiliary radiator 3 may not be limited to the inverter and may be other apparatuses such as a motor.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A heat exchanger apparatus comprising:

a condenser having:

a condensation part for cooling and condensing gaseous refrigerant by heat exchange with cooling air passing through the condenser;

a receiver for removing liquid refrigerant from the refrigerant condensed by the condensation part; and a supercooling part for supercooling the liquid refrigerant from the receiver by heat exchange with the cooling air; and an auxiliary radiator for cooling an exothermic component, the auxiliary radiator being disposed on a cooling air upstream side of the condenser and facing the condenser except at least a part of the supercooling part, wherein:

the supercooling part has a height B1 in a direction perpendicular to a flowing direction in which the refrigerant flows; and the auxiliary radiator has a part facing the supercooling part, the part of the auxiliary radiator having a height A1, a ratio of which relative to the height B1 is equal to or less than 0.85.

2. The heat exchanger apparatus of claim 1, further comprising a radiator for cooling an engine of a vehicle, disposed on a cooling air downstream side of the condenser.

3. The heat exchanger apparatus of claim 1, further comprising:

a member disposed between the auxiliary radiator and the exothermic component for providing a cooling water circulating passage, in which cooling water circulates; and a pump for circulating the cooling water in the cooling water circulating passage, wherein the auxiliary radiator cools the cooling water flowing therein by exchanging heat with the cooling air.

4. A heat exchanger apparatus comprising:

a condenser having a core portion including a tube extending in a refrigerant flow direction in which refrigerant flows, an inlet tank connected to the core portion and having an inlet for conducting the refrigerant into the tube, and an outlet tank connected to the core portion and having an outlet for discharging the refrigerant from the tube, the condenser being for cooling the refrigerant flowing in the tube by heat exchange with cooling air flowing outside of the tube;

an auxiliary radiator for cooling an exothermic component, the auxiliary radiator being disposed on a cooling air upstream side of the condenser; and a receiver communicating with the core portion of the condenser for separating the refrigerant cooled in the core portion into gaseous refrigerant and liquid refrigerant; wherein:

the core portion of the condenser is divided along the refrigerant flow direction into a first region and a second region closer to the outlet than the first region;

only the first region faces the auxiliary radiator;

the first region has a width approximately equal to a width of the auxiliary radiator in the refrigerant flow direction;

the core portion of the condenser has a condensation part for condensing the refrigerant between the inlet tank and the receiver and a supercooling part for supercooling the liquid refrigerant separated by the receiver between the receiver and the outlet tank; and the second region is at least part of the supercooling part;

the supercooling part has a height B1 in a height direction perpendicular to the refrigerant flow direction;

the auxiliary radiator has a part facing the supercooling part with a height A1 in the height direction; and a ratio of the height A1 relative to the height B1 is equal to or less than 0.85.

5. A heat exchanger apparatus comprising:

a first heat exchanger having a core portion including a plurality of tubes in which first fluid flows in a first fluid flow direction to exchange heat with air flowing outside the core portion in an air flow direction, an inlet tank communicating with the core portion for conducting the first fluid therein, and an outlet tank communicating with the core portion for discharging the first fluid therefrom, the plurality of tubes of the core portion extending in the first fluid direction, and including a first group of tubes directly communicating with the inlet tank and a second group of tubes directly communicating with the outlet tank; and a second heat exchanger disposed on an air upstream side of the first heat exchanger for exchanging heat between a second fluid different from the first fluid and flowing therein and the air, the second heat exchanger including a first part facing the first group of tubes and a second part facing a part of the second group of tubes, wherein:

the second part of the second heat exchanger has a height A1 in a height direction perpendicular to the first fluid flow direction;

the second group of tube has a height B1 in the height direction; and a ratio of the height A1 relative to the height B1 is equal to or less than 0.85.

6. The heat exchanger apparatus of claim 5, wherein a width of the first heat exchanger is approximately equal to a width of the second heat exchanger in the first fluid flow direction.

7. The heat exchanger apparatus of claim 5, wherein the first part of the second heat exchanger faces almost an entire region of the first group of tubes.

8. The heat exchanger apparatus of claim 5, wherein:

the first group of tubes constitutes a condensation part of the condenser for cooling and condensing the first fluid; and the second group of tubes constitutes a supercooling part for supercooling the refrigerant from the condensation part.

9. The heat exchanger apparatus of claim 5, wherein, the first fluid flows in the first group of tubes in a first direction parallel to the first fluid flow direction, and flows in the second group of the tubes in a second direction opposite the first direction.

* * * * *